US005622526A

United States Patent [19]

Phillips

[11] Patent Number: 5,622,526

[45] Date of Patent: Apr. 22, 1997

[54] APPARATUS FOR TRUEING CBN ABRASIVE BELTS AND GRINDING WHEELS

[75] Inventor: James D. Phillips, Posen, Mich.

[73] Assignee: J. D. Phillips Corporation, Alpena, Mich.

[21] Appl. No.: 218,427

[22] Filed: Mar. 28, 1994

[51] Int. Cl.[6] ..... B24B 7/00

[52] U.S. Cl. ..... 451/72; 125/11.01; 125/11.03

[58] Field of Search ..... 125/11.01, 11.02, 125/11.03, 11.04, 11.18, 11.21, 36, 38, 39; 451/72, 444, 449, 296

[56] References Cited

U.S. PATENT DOCUMENTS

| | | | |
|---|---|---|---|
| 2,860,622 | 9/1958 | Hider | 125/11.02 |
| 4,051,830 | 10/1977 | Gruber | 125/11.03 |
| 4,122,635 | 10/1978 | Asano et al. | 451/5 |
| 4,286,568 | 9/1981 | Komandure | 125/39 |
| 4,423,570 | 1/1984 | Bartosek | 125/11.01 |
| 4,720,939 | 1/1988 | Simpson et al. | 451/296 |
| 4,915,089 | 4/1990 | Ruark et al. | 125/11 |
| 4,920,945 | 5/1990 | Wedeniwski | 125/11.03 |
| 4,936,051 | 6/1990 | Waelti | 125/11.01 |
| 5,058,562 | 10/1991 | Tsutsui et al. | 125/11.03 |

FOREIGN PATENT DOCUMENTS

| | | |
|---|---|---|
| 0116668 | 2/1983 | European Pat. Off. . |
| 1141641 | 2/1966 | United Kingdom . |
| WO88/05367 | 7/1988 | WIPO . |

*Primary Examiner*—D. S. Meislin
*Assistant Examiner*—Dona C. Edwards
*Attorney, Agent, or Firm*—Barnes, Kisselle, Raisch, Choate, Whittemore & Hulbert, P.C.

[57] ABSTRACT

A trueing wheel for trueing an abrasive belt or wheel having cubic boron nitride abrasive particles. The trueing wheel has a radially outer peripheral surface which slopes at an acute angle with respect to its axis of rotation. Diamond particles, preferably about 0.150 mm in diameter, are bonded to the sloping radially outer peripheral surface in a single layer.

6 Claims, 2 Drawing Sheets

APPARATUS FOR TRUEING CBN ABRASIVE BELTS AND GRINDING WHEELS

This invention relates generally to a tool for trueing abrasive belts and grinding wheels, particularly cubic boron nitride (CBN) belts and wheels.

BACKGROUND AND SUMMARY OF THE INVENTION

In the past, CBN abrasive belts and grinding wheels have been very difficult to true. This is because the CBN grains on the belt or wheel are extremely hard, and somewhat slippery, that is, they can be fairly easily dislodged from their bond. Because of their hardness (slightly less than diamond), a great deal of force is required to cut the CBN grains with a diamond trueing wheel. Because the CBN grains are somewhat slippery, it is difficult for the bond to retain them.

A typical diamond trueing wheel employs diamonds that are anywhere from 0.7 millimeters (mm) to 2.0 mm in diameter, and when the trueing wheel is new, the contact area is relatively small. As the trueing wheel wears down, the contact area becomes larger and larger, because the diamond particles are worn down to their maximum cross-dimension. The trueing force increases as the contact area increases and accordingly long before the diamond is worn out, the CBN grains start to dislodge from the bond.

As the diamonds on the trueing wheel wear, additional adjacent diamonds come in contact with the belt or wheel being trued and this also substantially increases the contact area, with the result that the trueing force increases and the quality of trueing goes down. This decrease in quality begins even before the CBN grains begin to dislodge from the bond.

It has been found that it is of great importance to reduce the amount of force on the CBN grains during trueing, so that they do not come loose or dislodge. It is also important to maintain the force of contact uniform and constant throughout the life of the trueing wheel, preventing any substantial increase in this force, so that the quality of trueing is consistent.

One way of accomplishing this, in accordance with the invention, is by reducing the size of the diamond particles used in the trueing wheel to about 0.150 mm diameter. This assures that the contact area will remain small and the CBN grains will not be dislodged.

Further, in accordance with the invention, the radially outer surface of the trueing wheel is formed at an acute angle to its axis of rotation, rather than perpendicular to the axis of rotation as has been done in the past, and only a single layer of the diamond particles is applied to the outer surface. As the trueing wheel wears down, there are new, small diamond particles exposed so that the trueing wheel performs virtually the same as when it was new, without any appreciable increase in the amount of force applied.

One object of this invention is to provide a trueing wheel having the foregoing features.

Another object is to provide a trueing wheel of relatively simple, inexpensive construction, which is durable and long lasting, and which can be relatively inexpensively manufactured.

Other objects, features and advantages of the invention will become more apparent as the following description proceeds, especially when considered with the accompanying drawings.

DETAILED DESCRIPTION

Figure 1:
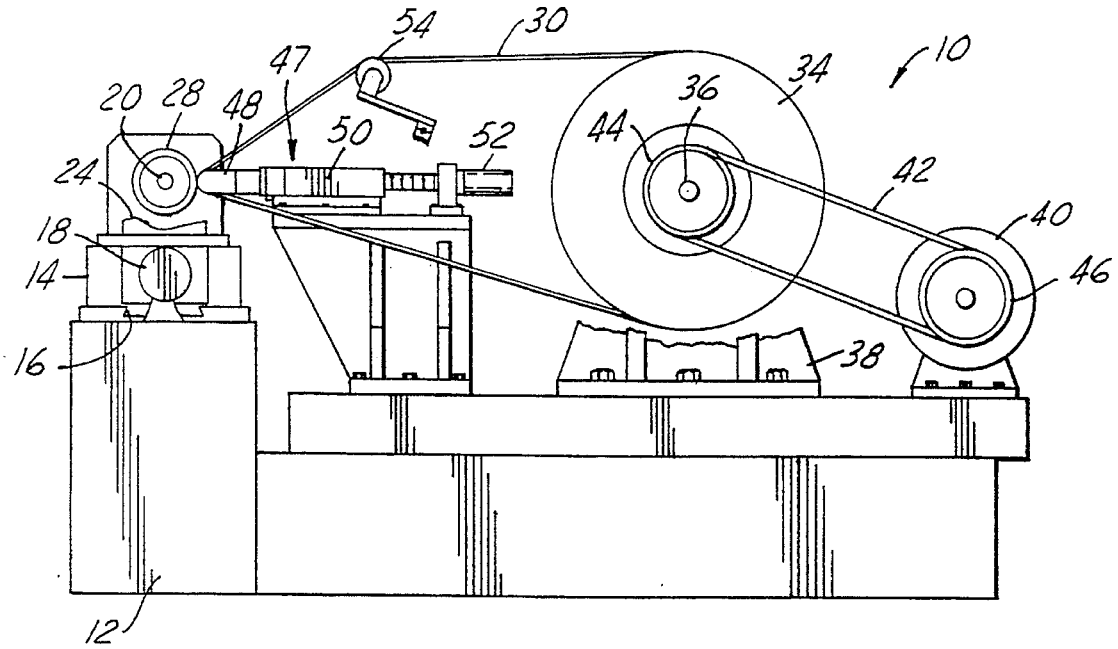
FIG. 1 is a side elevational view, with parts broken away, of apparatus for trueing abrasive belts, and employing trueing wheels constructed in accordance with the invention.
Figure 2:
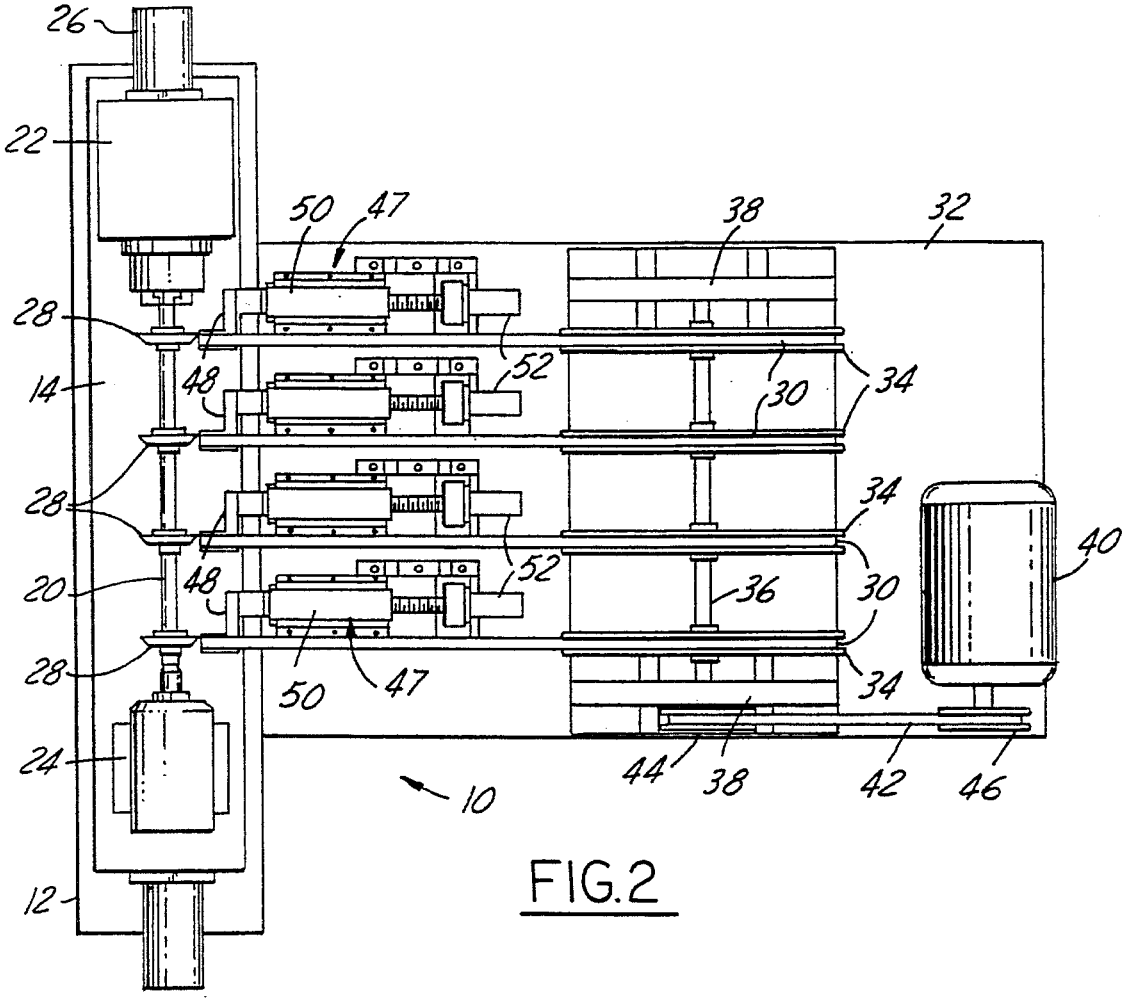
FIG. 2 is a top plan view of the apparatus shown in FIG. 1.

Referring now more particularly to the drawings and especially to FIGS. 1 and 2, the numeral 10 designates trueing apparatus having a base 12 on which is mounted an elongated slide 14. The slide 14 is supported in a dovetail track 16 formed on the base 12 for sliding movement in the direction of its length. The slide 14 is reciprocated by a ball screw drive and motor 18 mounted on the base.

A shaft 20 is supported for rotation on the slide 14 by mounts 22 and 24. The shaft 20 extends lengthwise of the slide and is rotated by a motor 26. A plurality of trueing wheels or discs 28 are secured to the shaft 20 in spaced apart relation along the length of the shaft.

A plurality of laterally spaced apart endless abrasive belts 30 are supported on an extension 32 of the base. Each abrasive belt extends around a pulley 34. The pulleys are secured in laterally spaced apart relation on a shaft 36 rotatably supported at its ends on side frame members 38 mounted on the base extension 32. The shaft 36 is rotated by a motor 40 mounted on the base extension 32. A drive belt 42 extends over a pulley 44 on the shaft 36 and over a pulley 46 on the output shaft of the motor 40.

The abrasive belts orbit in planes perpendicular to the shaft 20 on which the trueing wheels 28 are mounted. A back-up assembly 47 is provided for each abrasive belt to hold it in contact with one of the trueing wheels. Each of the back-up assemblies 47 comprises a nosepiece 48 in contact with the inner surface of a belt. Each nosepiece 48 is slidably supported in a frame 50 and is moved toward and away from the associated trueing wheel by a motor and ball screw drive 52. The back-up assemblies 47 are also mounted on the base extension 32.

A belt take-up unit 54 is provided for each belt 30, to take up slack as the belts orbit around the paths defined by the pulleys 34 and nosepieces 48.

Each belt 30 is made of a suitable, flexible material and has grains of cubic boron nitride (CBN) abrasive 56 bonded to the outer surface with a suitable bond 58.

Each trueing wheel 28 comprises a wheel body 60 having a frusto-conical, radially outer peripheral surface 62 which extends at an acute angle to the axis of rotation 64. Diamond grains or particles 66 are attached to the radially outer surface of the trueing wheel in a bond 68. The bond may, for example, be a nickel plate.

The acute angle of the radially outer surface 62 of the trueing wheel 28 to the axis of rotation 64 thereof may be in a range of about 15° to about 60° and preferably about 45°.

The trueing wheel body may be made of a relatively soft steel, that is, one which will be worn away by the abrasive grains in the abrasive belt without having any appreciable trueing effect.

The diamond grains 66 on the periphery of trueing wheels 28 are preferably about 0.150 mm in diameter and preferably are distributed in a single layer of about 0.150 mm or slightly more in thickness.

Figure 3:
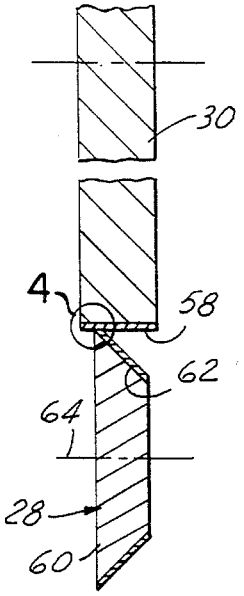
FIG. 3 is a detail view, on an enlarged scale, showing a trueing wheel of this invention making contact with the surface of an abrasive belt.
Figure 4:
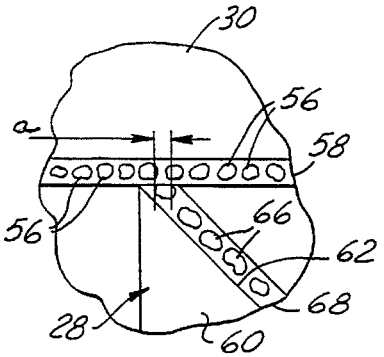
FIG. 4 is an enlarged view of the portion of FIG. 3 within the circle 4 illustrating an unused trueing wheel.
Figure 5:
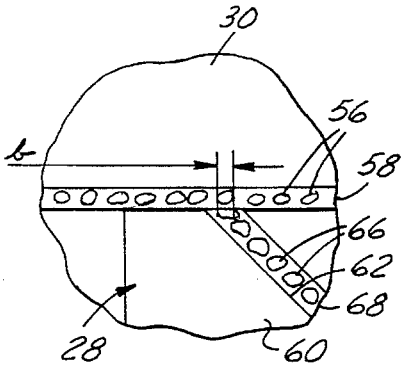
FIG. 5 is a view similar to FIG. 4 but shows the condition of the trueing wheel after a considerable period of use.

FIGS. 3 and 4 show a new, or unused, trueing wheel 28 making contact with the abrasive surface of an abrasive belt 30. FIG. 4 shows that with a single layer of diamond particles averaging 0.150 mm diameter, the extent of the contact area "a" measured across a single diamond particle is about 0.150 mm. FIG. 5 shows that even after a period of use, when the periphery of the trueing wheel is worn down, the extent of the contact area "b" across a diamond particle is still the same, that is, about 0.150 mm. Because this area remains the same, and therefore the force also remains the same as the trueing wheel traverses across the abrasive belt, the trueing is very accurate and straight because it is not influenced by a varying force.

The total contact area both when the trueing wheel is new and after a period of use, no matter what the wheel thickness or diameter, is about $0.0176^2$ mm. This, of course, does not include the steel body of the wheel which wears down but has no abrasive or cutting action.

Figure 6:
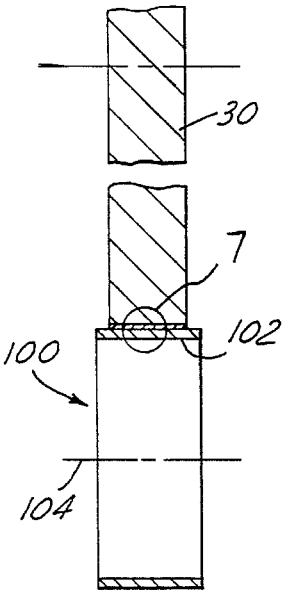
(PRIOR ART) FIG.6
FIG. 6 is a detail view, on an enlarged scale, showing a prior art trueing wheel making contact with the surface of an abrasive belt.

FIG. 6 shows a new, or unused trueing wheel 100 made according to the prior art in which the radially outer peripheral surface 102 is parallel to the axis of rotation 104. The diamond particles 106 have a much larger average maximum cross dimension of about 2 mm. The diamond particles are bonded to the radially outer surface 102 by a bond 108 which may be the same as used in the trueing wheels 28 of this invention.

Figure 7:
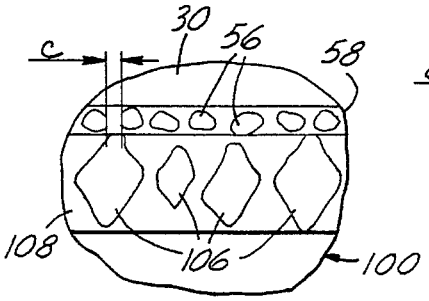
(PRIOR ART) FIG.7
FIG. 7 is an enlarged view of the portion of FIG. 6 within the circle 7 illustrating an unused prior art trueing wheel.
Figure 8:
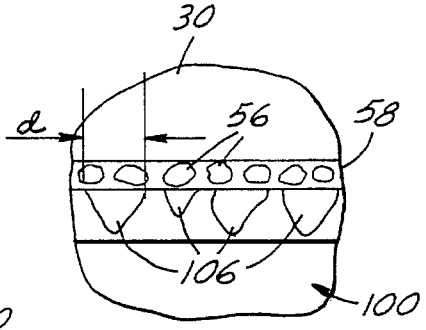
(PRIOR ART) FIG.8
FIG. 8 is a view similar to FIG. 7, but showing the prior art trueing wheel after a considerable period of use.

FIG. 7 shows the diamond particles 106 as being in a single layer. When the wheel 100 is new, the extent of the area of contact "c" across a single diamond particle is relatively small, measuring about 0.500 mm. The total area of contact across the trueing wheel 100 (assuming it has a thickness or width of ¾ inch) is about $2.0^2$ mm. However, after a period of use (FIG. 8) when the trueing wheel 100 is worn down, the extent of the contact area "d" across a single diamond particle is about 2 mm which is the average maximum particle diameter, and the total contact area for a ¾ inch trueing wheel is about $31.4^2$ mm. Thus, a prior art trueing wheel applies much more force against the abrasive belt (or abrasive wheel) being trued, causing more CBN abrasive grains to pop out of the bond.

Also, not only is the force greater, it varies considerably, because as the trueing wheel starts at the edge of the abrasive belt the force is comparatively light, but increases as more area of the trueing wheel comes in contact with the abrasive belt. The force will be highest when the full width of the trueing wheel is in contact with the abrasive belt, but then again decreases as the trueing wheel continues moving off the other side of the abrasive belt. This varying force or pressure causes the trueing wheel to put a crown on the abrasive belt instead of a straight and flat surface.

What is claimed is:

1. A method of trueing an abrasive surface of a grinder comprising:

providing a rotating trueing wheel formed with a frustoconical peripheral surface which is disposed at an acute angle to the axis of rotation of the trueing wheel and which has first and second side edges with the first side edge being of greater diameter than the second side edge and with a plurality of diamond particles distributed in a single layer over the entirety of said peripheral surface, initially holding the first side edge only of the peripheral surface of the rotating trueing wheel in engagement with the abrasive surface of the grinder while maintaining the rotating trueing wheel oriented such that the remainder of the peripheral surface of the rotating trueing wheel is disposed at an acute angle to the abrasive surface of the grinder and out of contact therewith to confine the trueing of the abrasive surface to a relatively small area of contact by the diamond particles along the first side edge of the peripheral surface, and continuing such engagement and the trueing of the abrasive surface while maintaining the rotating trueing wheel at the same orientation so that as the first side edge wears away trueing will continue to be confined to a relatively small area of contact by diamond particles progressively farther and farther from said first side edge.

2. A method as defined in claim 1, wherein said diamond particles average about 0.150 millimeters in diameter.

3. A method as defined in claim 1, wherein the grinder is an endless abrasive belt having cubic boron nitride abrasive particles in the abrasive surface, and orbiting said belt in a plane perpendicular to the axis of rotation of the trueing wheel during trueing of said abrasive surface.

4. A method as defined in claim 3, wherein the peripheral surface of the trueing wheel slopes with respect to the axis of rotation thereof at an angle in the range of about 15°–60°.

5. A method as defined in claim 3, wherein said diamond particles are formed in a single, relatively thin layer and average about 0.150 millimeters in diameter.

6. A method as defined in claim 5, wherein the peripheral surface of the trueing wheel slopes with respect to the axis of rotation thereof at an angle of about 45°.

* * * * *